US009151076B2

(12) United States Patent
George et al.

(10) Patent No.: US 9,151,076 B2
(45) **Date of Patent: *Oct. 6, 2015**

(54) DEVICE FOR IMPROVED CLEAN UP OF HOLES

(71) Applicants: Eric Gore, Bradley, IL (US); Nicholas George, Peotone, IL (US)

(72) Inventors: Nicholas A. George, Peotone, IL (US); Eric A. Gore, Bradley, IL (US); Scott Daigle, Champaign, IL (US)

(73) Assignees: Nicholas George, Peotone, IL (US); Eric Gore, Bradley, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/315,315

(22) Filed: Jun. 25, 2014

(65) Prior Publication Data

US 2015/0000986 A1 Jan. 1, 2015

Related U.S. Application Data

(63) Continuation-in-part of application No. 13/928,044, filed on Jun. 26, 2013, now Pat. No. 8,991,512.

(51) Int. Cl.

| | |
|---|---|
| ***A01B 13/00*** | (2006.01) |
| ***E21B 21/015*** | (2006.01) |
| ***E04H 17/26*** | (2006.01) |

(52) U.S. Cl.

CPC ..... *E04H 17/26* (2013.01); *E21B 21/015* (2013.01)

(58) Field of Classification Search

CPC ..... E21B 12/00; E21B 21/015; E04H 17/26
USPC ..... 56/1, 328.1, 329; 172/25; 37/466, 468, 37/411, 420, 434; 294/1.1, 137, 59, 50.5, 294/1.5, 149, 152; 141/390, 391; 248/95, 248/99

See application file for complete search history.

(56) References Cited

U.S. PATENT DOCUMENTS

| | | | | |
|---|---|---|---|---|
| 2,519,678 | A * | 8/1950 | MacKenzie | 56/329 |
| 5,088,751 | A | 2/1992 | Zint | |
| D394,929 | S * | 6/1998 | Ahumada | D34/1 |
| D408,233 | S * | 4/1999 | Price | D8/1 |
| 6,128,852 | A * | 10/2000 | Hansen | 47/32 |
| 6,315,310 | B1 | 11/2001 | Hurt | |
| 6,953,213 | B2 * | 10/2005 | Yardley et al. | 294/215 |
| D562,647 | S * | 2/2008 | Baars | D8/1 |
| 7,552,956 | B1 * | 6/2009 | Holloway | 294/214 |
| 2003/0097772 | A1 | 5/2003 | Christensen | |

* cited by examiner

*Primary Examiner* — Robert Pezzuto
(74) *Attorney, Agent, or Firm* — McDonnell Boehnen Hulbert & Berghoff LLP.

(57) ABSTRACT

A device for the cleanup of dirt or soil removed when forming a hole in the earth including a base member, a first side member attached to a first side of the base member, a second side member attached to a second side of the base member, an aperture positioned within the base member, wherein the first side member is movable to an upright position and the second side member is movable to an upright position for directing dirt or soil off of the base member.

16 Claims, 15 Drawing Sheets

DEVICE FOR IMPROVED CLEAN UP OF HOLES

BACKGROUND

The present application generally relates to devices for cleaning up dirt and soil resulting from boring or digging a hole in the earth, when using an auger or other digging tool such as a clamshell digger. More particularly, the present application relates to a device that may be used to collect and remove the dirt and soil displaced when boring or digging a hole for a post, such as a fence post or post for a deck.

Professional tradesmen, carpenters, and others are often called upon to build fences or decks. Posts are typically positioned at intervals to support the fences or decks. The bottom of the posts are positioned in holes that are bored or dug into the earth, and once the post is positioned within the hole, some of the dirt or soil may be filled in around the post or the post may be set in concrete, as examples.

The holes may be bored into the ground using a power auger. Alternatively, the holes may be bored or dug using handheld tools such as a shovel, spade, hand auger or a clamshell digger, or some combination thereof. Regardless of how the hole is created, the hole is formed by removing dirt and soil (or sand or gravel) from the earth, which becomes piled up around the hole. During the course of boring or digging the holes and positioning posts within the holes, the dirt and soil piled around the holes may also get stepped on and tracked around the yard. Eventually, after the posts are positioned within the holes, the dirt and soil piled up around the posts, and the dirt and soil tracked around the yard needs to be cleaned up and removed.

The process of cleaning and removing the dirt and soil around each post, and the dirt and soil tracked around the yard, may be a time-consuming and tedious process. It may take two workers 20 to 30 minutes per post to properly clean up the area around each post. The cleanup process may involve shoveling the dirt and soil piled up around the posts and moving it into a wheelbarrow or cart where it may be removed from the area. The cleanup process may also entail using a shop vacuum and/or hosing down the grass to return the yard to a pristine condition. A typical fence may have 30 to 50 posts. Therefore, there is a significant amount of time and expense involved in cleaning up the dirt and soil removed from the holes.

As a result of the labor-intensive and time-consuming cleanup process, it would be desirable to provide a device that can be used to more easily collect and remove the dirt and soil displaced from the holes. It would also be desirable to provide a tool that may be used that results in a reduction of time required to clean up the dirt and soil displaced from the holes during the hole forming process.

SUMMARY

In one aspect, a device for the cleanup of dirt or soil removed when forming a hole in the earth is provided having a first board, a second board hingedly connected to the first board with a first hinge, a third board hingedly connected to the second board with a second hinge, an aperture positioned within the second board, wherein the first board is movable to an upright position and the third board is movable to an upright position for directing dirt or soil off of the second board.

In a further aspect, a device for the cleanup of dirt or soil removed when forming a hole in the earth is provided having a base member, a first side member attached to a first side of the base member, a second side member attached to a second side of the base member, an aperture positioned within the base member, wherein the first side member is movable to an upright position and the second side member is movable to an upright position for directing dirt or soil off of the base member.

In a further aspect, a device for the cleanup of dirt or soil removed when forming a hole in the earth including a base having an aperture positioned therein, wherein the aperture has a diameter that is sized to accommodate an 8-inch auger positioned through the aperture when a hole is being drilled by the auger, one or more handles positioned on a first side of the base and one or more handles positioned on a second side of the base opposite from the first side of the base, wherein the first and second sides of the base comprises flexible material such that the portion of the base having the aperture sags between the first side and the second side of the base when the base is lifted by the handles.

BRIEF DESCRIPTION OF THE DRAWINGS

Exemplary embodiments of the invention are described herein with reference to the drawings, wherein like parts are designated by like reference numerals, and wherein.

DETAILED DESCRIPTION

Figure 1:
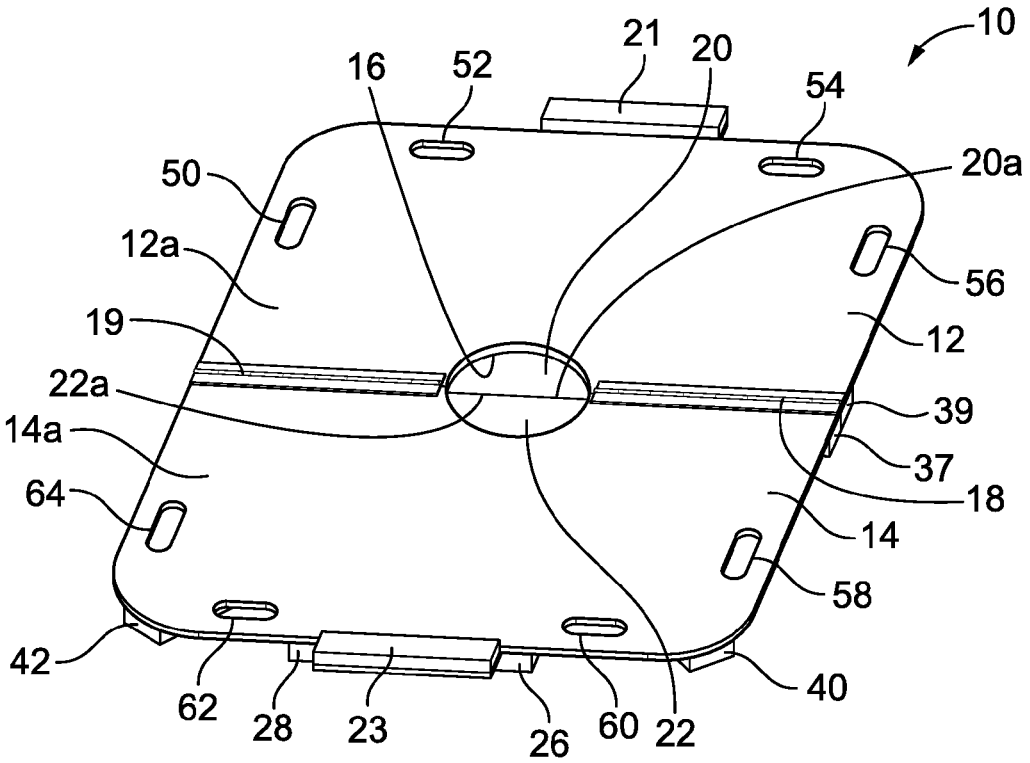
FIG. 1 is a perspective top view of cleanup device 10 with first plate 20 and second plate 22 in a second, closed position with respect to aperture 16.

FIG. 1 is a perspective top view of cleanup device 10 having a first board 12 attached to a second board 14 with hinge 18 and hinge 19. An aperture 16 is defined by a portion of first board 12 and a portion of second board 14, and is positioned between hinge 18 and hinge 19. In FIG. 1, a first plate 20 is shown in a closed position with respect to aperture 16, and second plate 22 is also shown in a closed position with respect to aperture 16. First board 12 includes a number of holes 50, 52, 54, and 56 that may serve as handholds for a user to hold onto when moving or transporting the cleanup device 10, or tilting the device when directing dirt or soil off of the boards. Similarly, second board 14 also includes a number of holes 58, 60, 62, and 64 that may also serve as handholds for a user to hold onto when moving or transporting the cleanup device 10, or tilting the device when directing dirt or soil off of the boards.

Figure 2:
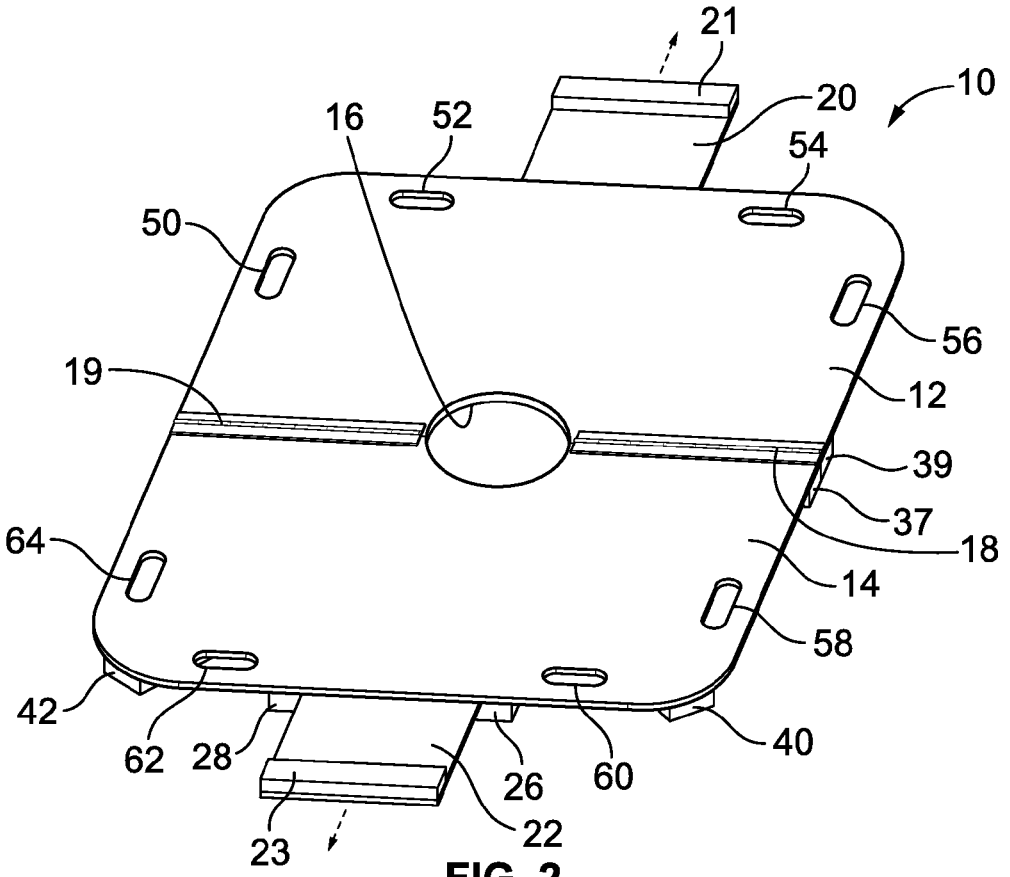
FIG. 2 is a perspective top view of the cleanup device 10 shown in FIG. 1, with first plate 20 and second plate 22 in a first, open position with respect to aperture 16.

FIG. 2 is a perspective top view of the cleanup device 10 shown in FIG. 1, with first plate 20 and second plate 22 in an open position with respect to aperture 16. Plate handle 21 may be used to pull plate 20 away from the aperture 16 to open aperture 16 and plate handle 23 may be used to pull plate 22 away from the aperture 16 to open aperture 16. When it is desired to move plates 20 and 22 back into a closed position, then plate handles 21 and 23 may be used to push the plates 20 and 22 back to a closed position shown in FIG. 1, where the aperture 16 is substantially closed. Plate 22 is shown have slidable movement between plate holders 26 and 28 and the bottom surface of board 14.

As shown in FIG. 1, an edge 20*a* of plate 20 is engaged with an edge 22*a* of plate 22 when the plates are in the closed position. It will be recognized that gaps could exist at the interface between edge 20*a* and edge 22*a* when the aperture is substantially closed. Therefore, as used herein, the term "substantially closed" means that the area of the aperture is at least 90% blocked by plate 20 and/or plate 22. Furthermore, while not shown in FIG. 1, one of the ends 20*a* or 22*a* could extend beyond the other of the ends 20*a* or 22*a* when the plates 20 and 22 are in the closed position.

Moreover, in some embodiments, only a single plate may be required. For example, a plate having a flexible end could be used to cover the aperture and bend when the board 12 and board 14 are moved into a V-shaped surface, while still covering the aperture 16. In addition, while plates 20 and 22 are shown positioned on the bottom of boards 12 and 14, it is also possible that plates 20 and 22 could be positioned on the top surface of boards 12 and 14.

Figure 3:
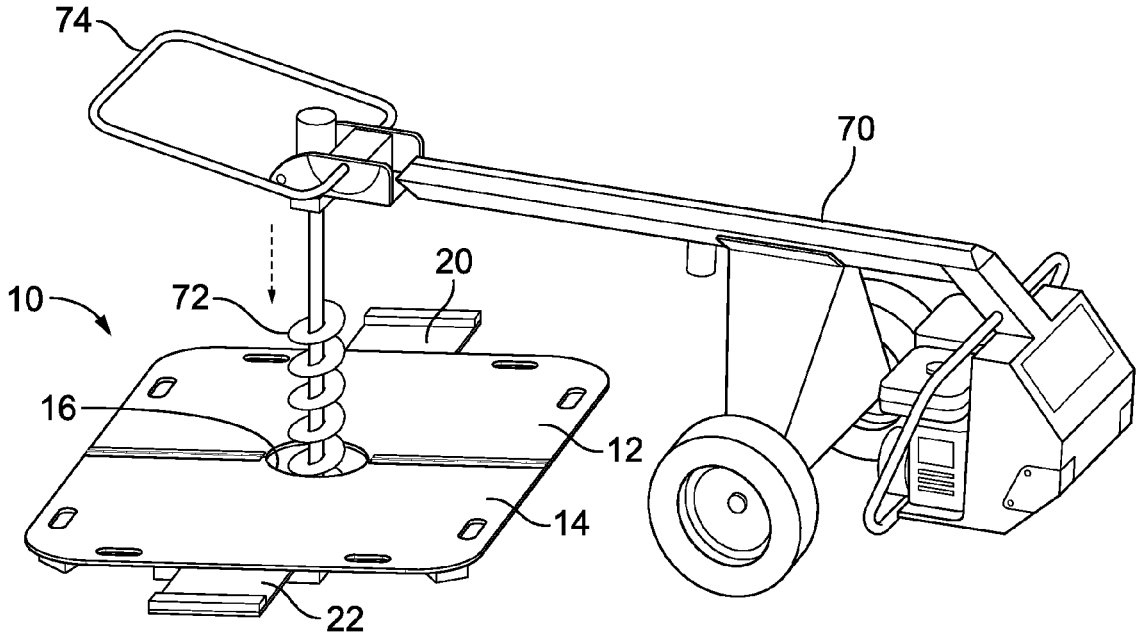
FIG. 3 is a perspective top view of the cleanup device 10 shown in FIGS. 1 and 2 with auger 72 positioned through aperture 16.

FIG. 3 is a perspective top view of the cleanup device 10 shown in FIGS. 1 and 2. In FIG. 3, a power auger 70 that may be used to bore holes for fence or deck posts is shown. A handle 74 is shown which may be used to position auger 72 through aperture 16 of cleanup device 10 and over a spot where it is desired to bore a hole. At this stage of the process the plates 20 and 22 are in the open position, before the hole has been bored.

Figure 4:
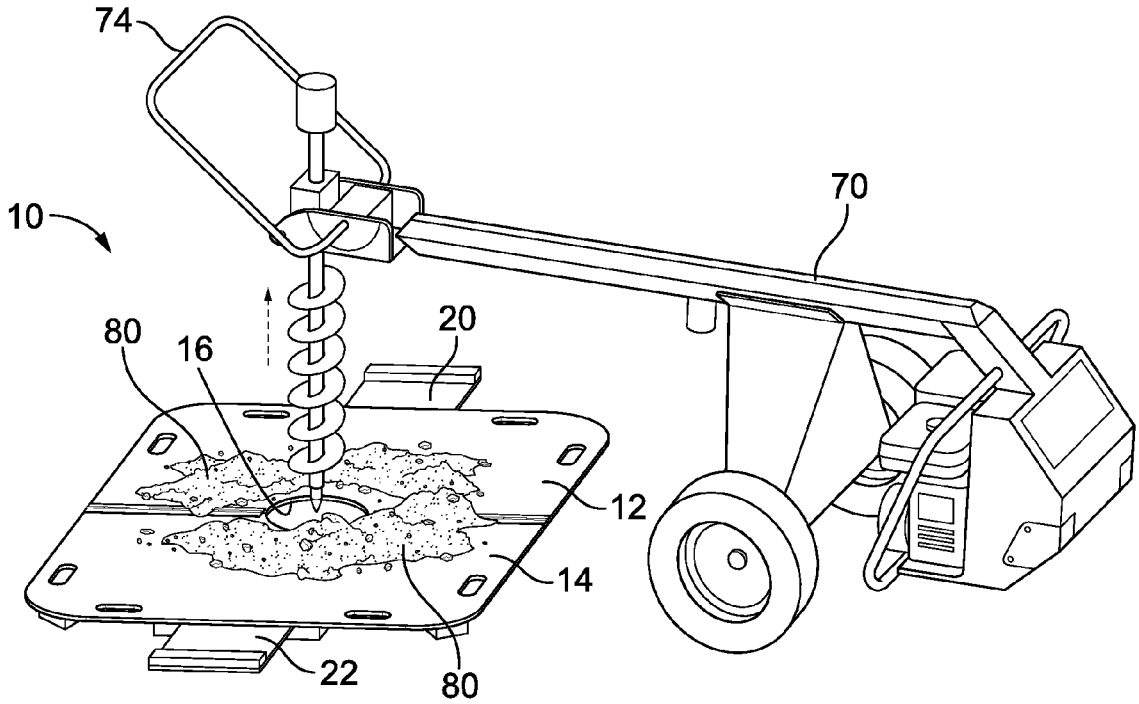
FIG. 4 is a perspective top view of cleanup device 10 shown in FIGS. 1-3 after a hole is been formed with dirt or soil 80 collected on cleanup device 10.

FIG. 4 is a perspective view showing the cleanup device 10 after a hole has been bored by the power auger 70 shown in FIG. 3. Typical holes may be bored 42 inches deep. As the hole is bored, dirt and soil are displaced from the hole and collected into piles 80 on top of board 12 and board 14. In this manner, the cleanup tool 10 may be used to collect the dirt and soil removed by the auger and prevent it from accumulating in piles directly on the grass surrounding the hole. In addition, if using handheld tools such as a clamshell digger, the dirt or soil displaced by such tools may also be collected and piled onto the top of board 12 and 14.

Figure 12:
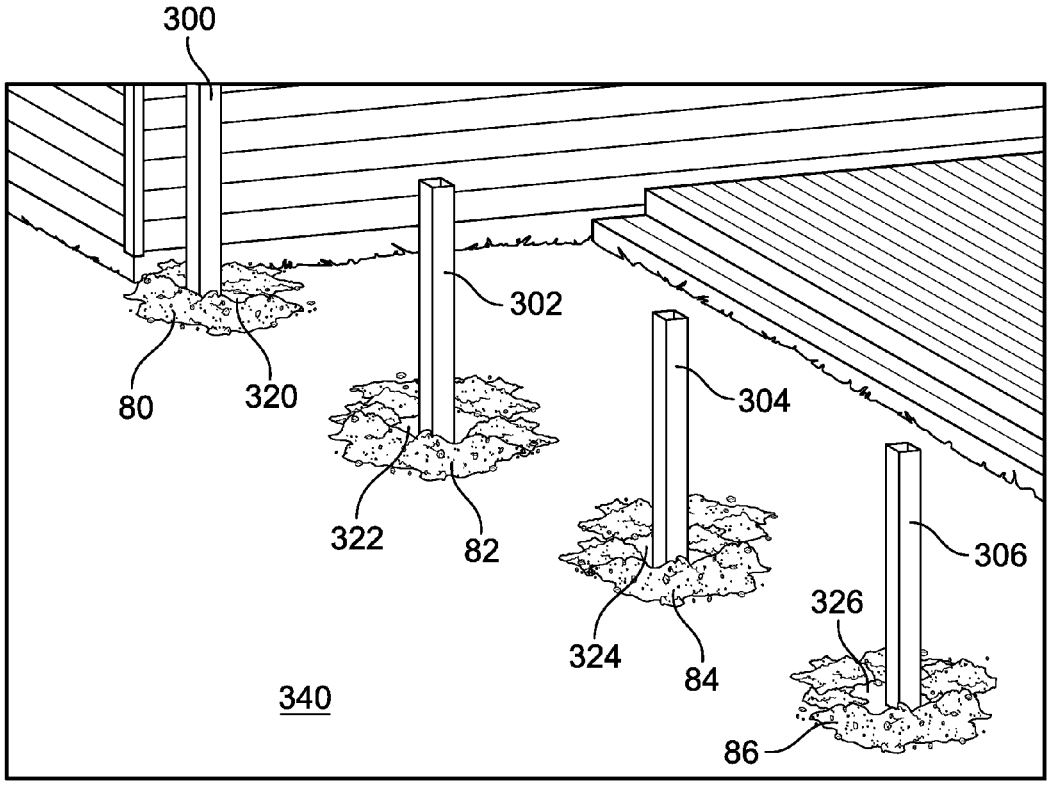
FIG. 12 is a perspective view of a series of posts after being positioned within holes formed in the earth, showing piles of dirt and soil surrounding the posts.

In the absence of using cleanup tool 10, after positioning the posts within the holes, each post would be surrounded by a pile of dirt or soil displaced from hole during the formation of the hole. In particular, FIG. 12 is a perspective view of a series of posts after being positioned within holes formed in the earth of yard 340 without the use of cleanup tool 10, showing piles of dirt and soil surrounding the posts. In particular, post 300 is shown positioned within hole 320 and surrounded by a pile of dirt and soil 80, post 302 is shown positioned within hole 322 and surrounded by a pile of dirt and soil 82, post 304 is shown positioned within hole 324 and surrounded by a pile of dirt and soil 84, and post 306 is shown positioned within hole 326 and surrounded by a pile of dirt and soil 80. Such piles are eliminated, or significantly reduced, when using cleanup 10 during the hole forming process.

Typical fence or deck posts may be 4 inches by 4 inches, in which case auger 72 may have an 8-inch diameter bit, while other fence and deck posts may be 5 inches by 5 inches, in which case auger 72 may have a 10-inch diameter bit. Therefore, the diameter of aperture 16 should be sized to accommodate at least an 8-inch bit. However, to accommodate both an 8-inch diameter bit and a 10-inch diameter bit, the diameter of aperture 16 should be 12 inches or more. However, the larger the diameter of the aperture, the more dirt and soil will drop back onto the area surrounding the hole, instead of onto boards 12 and 14 as is desired. Therefore, it has been found that an aperture with a diameter of 12 inches provides sufficient flexibility to accommodate an 8-inch bit and a 10-inch bit without allowing too much dirt or soil to fall through the aperture 16. It will be appreciated that while aperture 16 is shown as a circular hole, other geometries for the aperture which may not be as advantageous as a circular hole could be used as well. In addition, the cleanup device 10 may also be used for other larger applications. For example, a telephone pole may require a 16 inch diameter hole, and the aperture 16 of cleanup device 10 may be sized to accommodate a hole of that size, or larger, as well.

Figure 5:
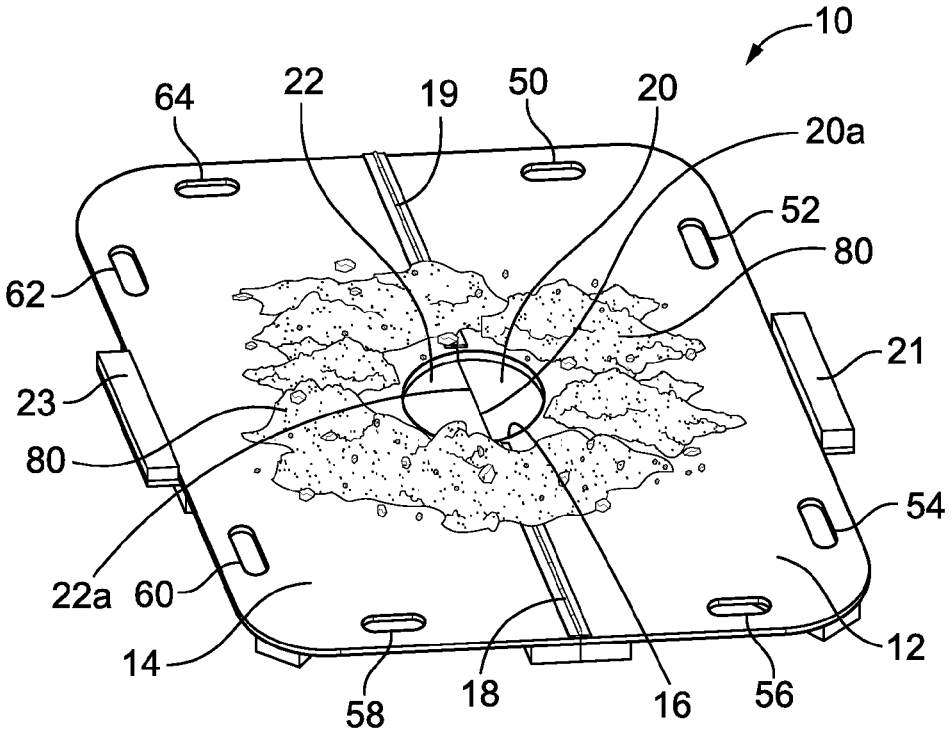
FIG. 5 is a perspective top view of cleanup device 10 shown in FIGS. 1-4 with first plate 20 and second plate 22 moved back to the second, closed position with respect to aperture 16 shown in FIG. 1.

FIG. 5 is a perspective top view of cleanup device 10 shown in FIGS. 1-4 after the auger has been removed. Piles of dirt or soil 80 are shown collected about aperture 16. Once the hole is completed and the auger or handheld tool such as a clam-shell digger are removed, first plate 20 and second plate 22 are shown moved back to the second, closed position with respect to aperture 16. The cleanup tool is now ready to remove the piles of dirt and soil 80 collected on top of boards 12 and 14 from the hole site.

Figure 6:
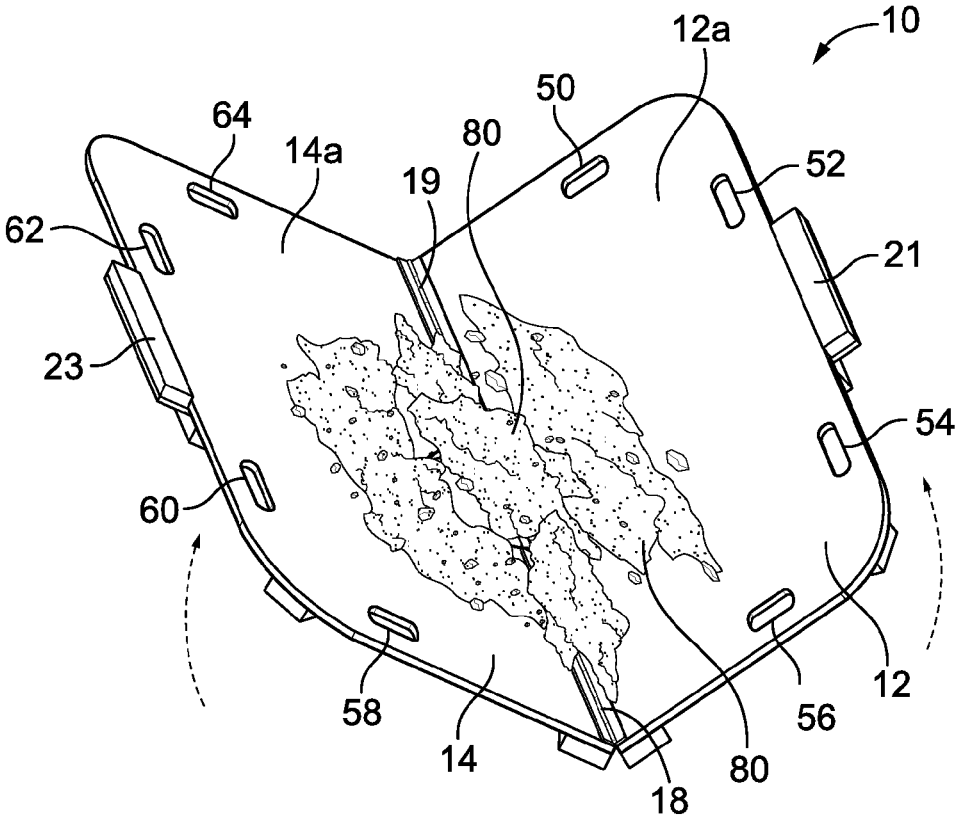
FIG. 6 is a perspective top view of the cleanup device shown in FIG. 5, with the top surface 12*a* of first board 12 moved towards the top surface 14*a* of second board 14 to form a V-shaped surface for directing the dirt or soil 80 off of the cleanup device 10.

FIG. 6 is a perspective top view of the cleanup device shown in FIG. 5, with the top surface 12*a* of first board 12 moved towards the top surface 14*a* of second board 14 to form a V-shaped surface for directing the dirt or soil 80 off of the cleanup device 10. In this example, hinges 18 and 19 are used to attach board 12 to board 14 and allow the boards to move to form a V-shaped surface. As used herein, the term "hinge" is to be interpreted broadly to include any device that can be used to attach an end of board 12 to an end of board 14 and allow upper surfaces 12*a* and 14*a* of boards 12 and 14 to move towards each and form a V-shaped surface.

It will be appreciated that hinges 18 and 19 may be used to allow the upper surface 12*a* and 14*a* of boards 12 and 14 to be drawn together into contact with each other, thereby enabling the cleanup device 10 to be folded which provides for more convenient transportation and storage of cleanup device 10.

Figure 7:
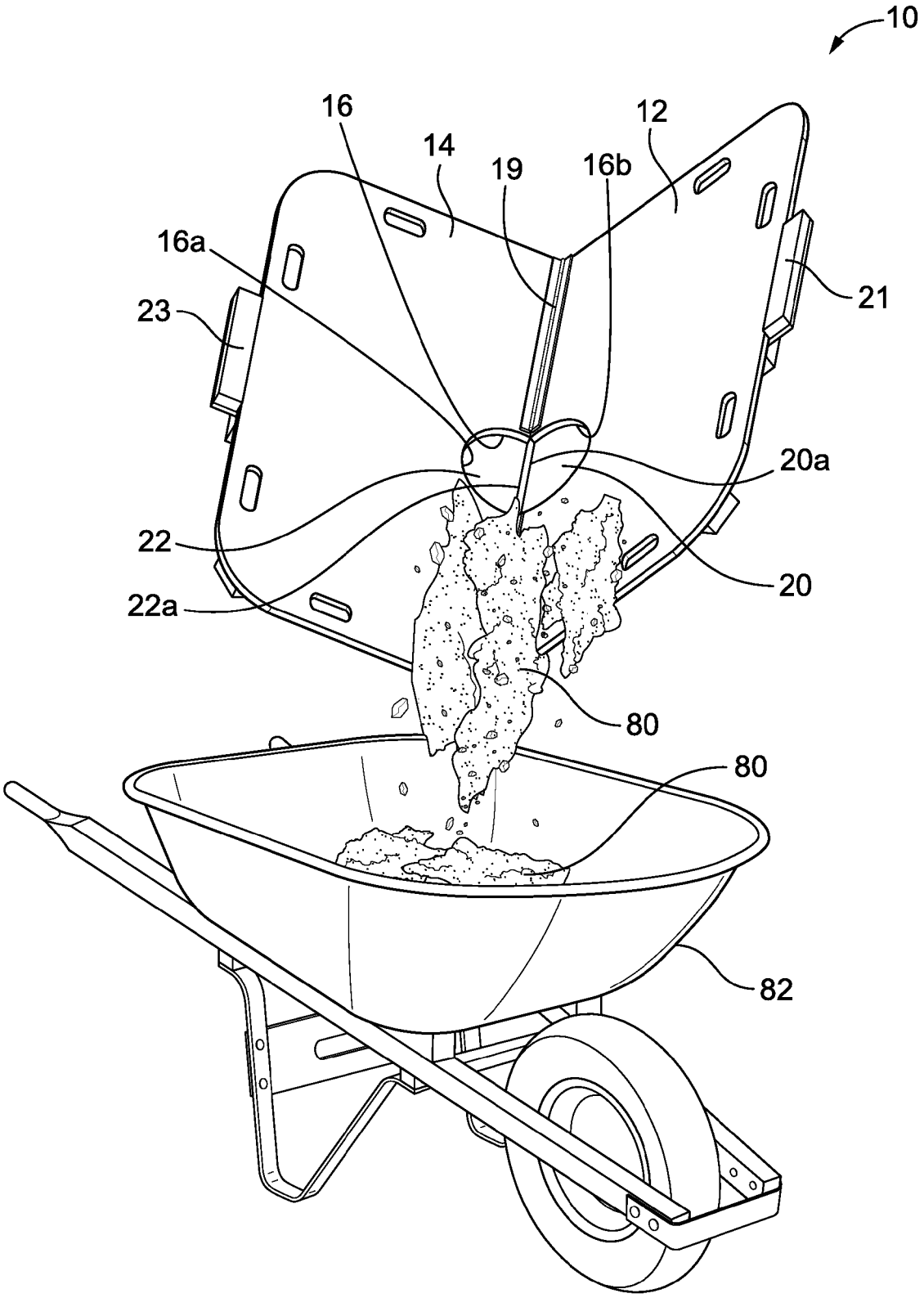
FIG. 7 is a perspective top view of the cleanup device 10 shown in FIG. 6 with the dirt or soil 80 being directed off of cleanup device 10.

FIG. 7 is a perspective top view of the cleanup device 10 shown in FIG. 6 with the dirt or soil 80 being directed off of cleanup device 10 with boards 12 and 14 formed into a V-shape surface. It will be noted that the ends 20*a* and 22*b* of plates 20 and 22 remain in the closed position during this step of the process where the aperture remains in a substantially closed position. In this step of the process, the piles of dirt or soil 80 are directed into wheelbarrow 82, where it may be further removed from the hole site.

Figure 8:
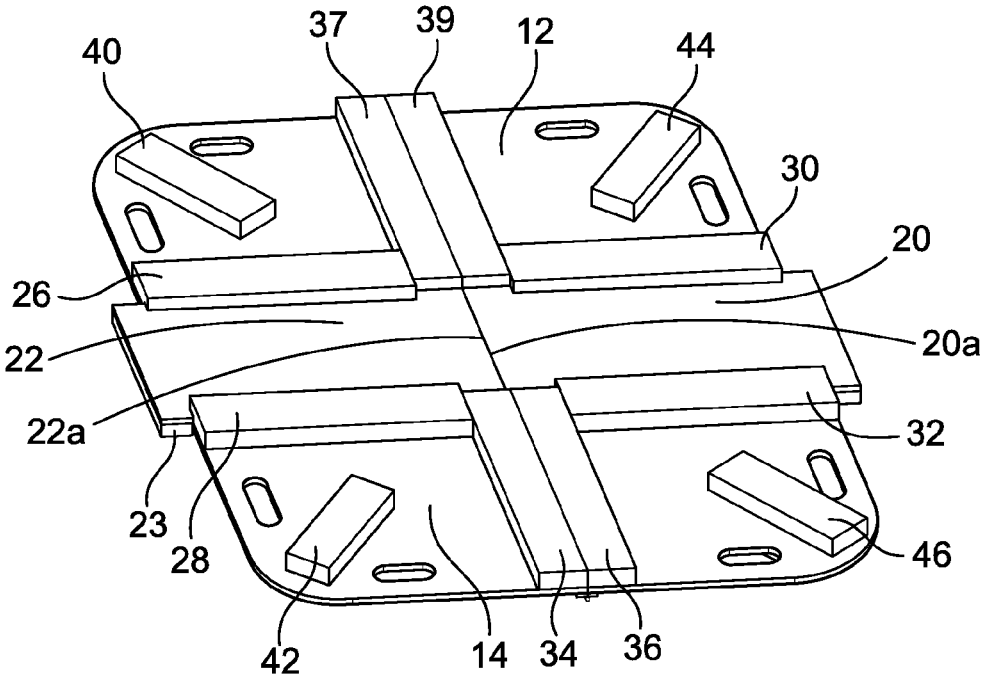
FIG. 8 is a perspective bottom view of the cleanup device 10 shown in FIGS. 1-7 with first plate 20 and second plate 22 in a second, closed position with respect to aperture 16.

FIG. 8 is a perspective bottom view of the cleanup device 10 shown in FIGS. 1-7 with first plate 20 and second plate 22 in a closed position with respect to aperture 16. Plate 20 is adapted for slidable linear movement between plate holders 30 and 32 and the bottom of board 12. Similarly, plate 22 is adapted for slidable linear movement between plate holders 26 and 28 and the bottom of board 14. Supports 37, 39, 34, and 36 are also positioned on the bottom of boards 12 or 14, and supports 40, 42, 44, and 46 are also positioned on the bottom of boards 12 or 14 to provide support for someone standing on cleanup tool 10 during the hole forming process. While the supports are shown as separate members attached the boards 12 or 14, this represents only an example configuration. It will be appreciated that the supports could be formed to together as a single unit, formed integrally with the board 12 or 14, and/or have different geometries.

Figure 9:
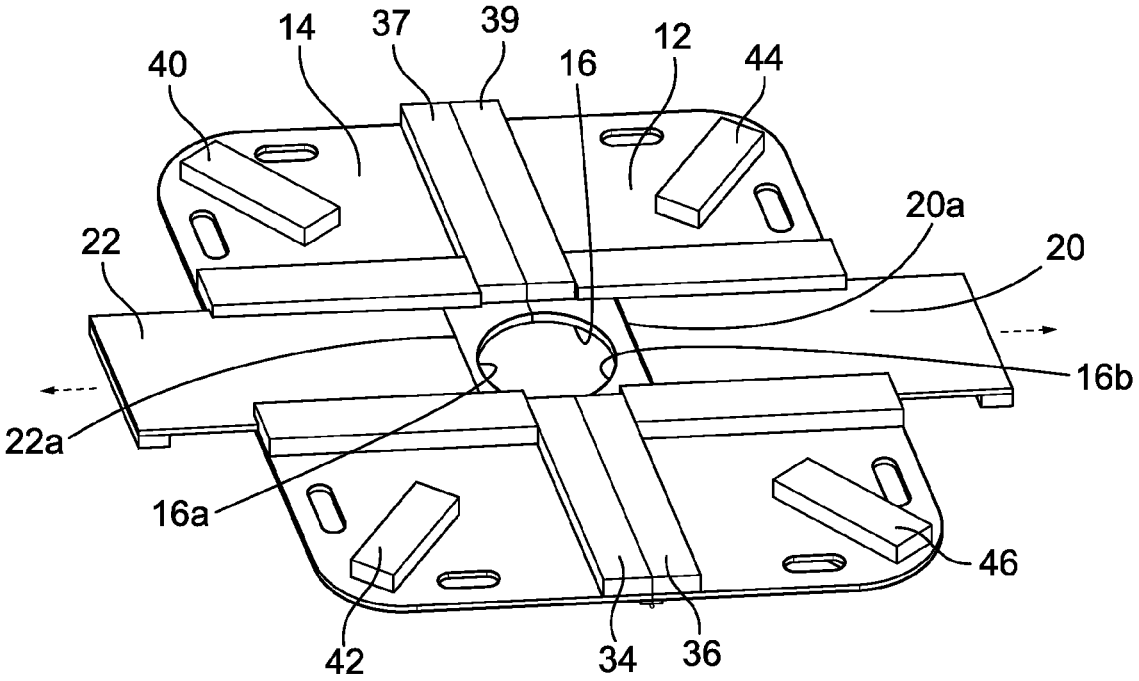
FIG. 9 is a perspective bottom view of the cleanup device 10 shown in FIGS. 1-8 with first plate 20 and second plate 22 in a first, open position with respect to aperture 16.

FIG. 9 is a perspective bottom view of the cleanup device 10 shown in FIGS. 1-8 with first plate 20 and second plate 22 in an open position with respect to aperture 16. Here the plates 20 and 22 have been pulled away from aperture 16 with a linear movement. However, it is also possible that the aperture could be opened or closed using a plate that is moved using rotational movement. For example, a plate could be rotated 90 degrees to move a plate over the aperture 16, and rotated back 90 degrees to move the plate away from aperture 16.

Figure 10:
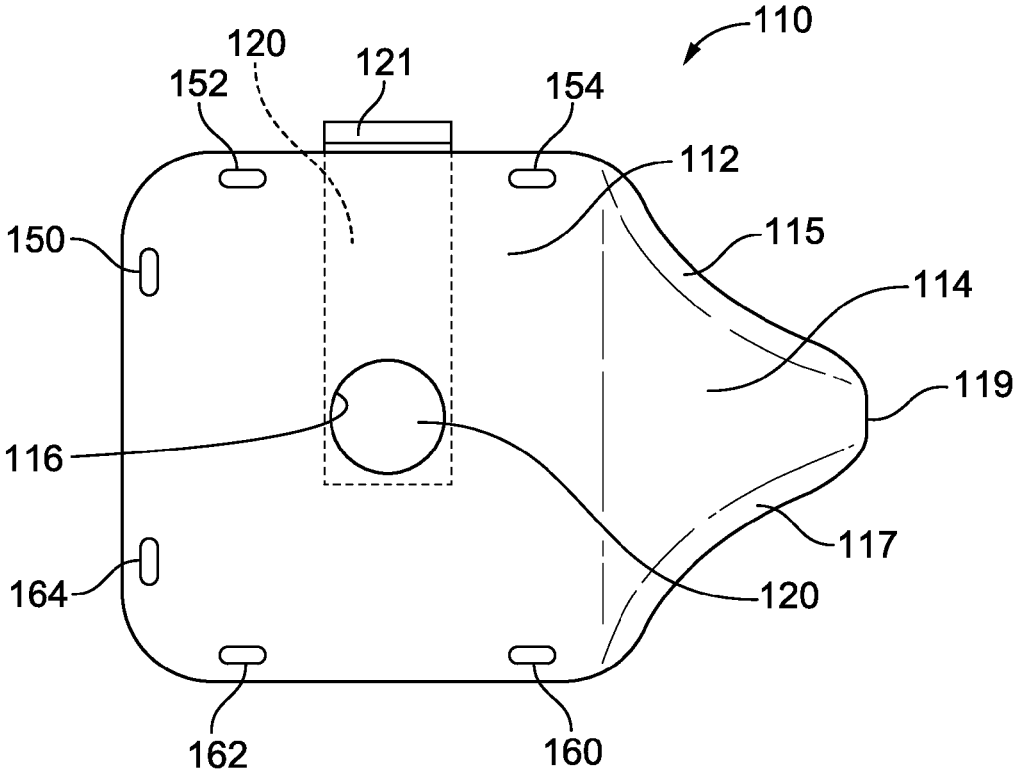
FIG. 10 is a top view of cleanup device 110 having a chute extending from an end thereof.

FIG. 10 is a top view of cleanup tool 110 having a chute 114 extending from an end thereof. The chute 114 may be a separate element attached to the board 112 or integrally formed with board 112. Cleanup tool 110 is similar to the cleanup tool 10 shown in FIGS. 1-9 with aperture 116 the same as aperture 16, and a plate 120 that is movable from a first closed position as shown in FIG. 10 to a second open position where the aperture 116 is open. Plate handle 121 may be used to move the plate 120 as desired. Cleanup tool 110 includes board 112 having aperture 116 extending through board 112, and holes 150, 152, 154, 160, 162, and 164 that may serve as handholds for manipulating and transporting cleanup tool 110.

Cleanup tool 110 further includes chute 114 that has a chute wall 115 and a chute wall 117 extending from board 112. Dirt or soil collected on the board 112 during the process of forming a hole may be directed off of board 112 by tilting the board so that the dirt and soil is directed through chute 114 and out of chute outlet 119. With this design, the cleanup tool 110 may have only one board and only one plate.

Figure 11:
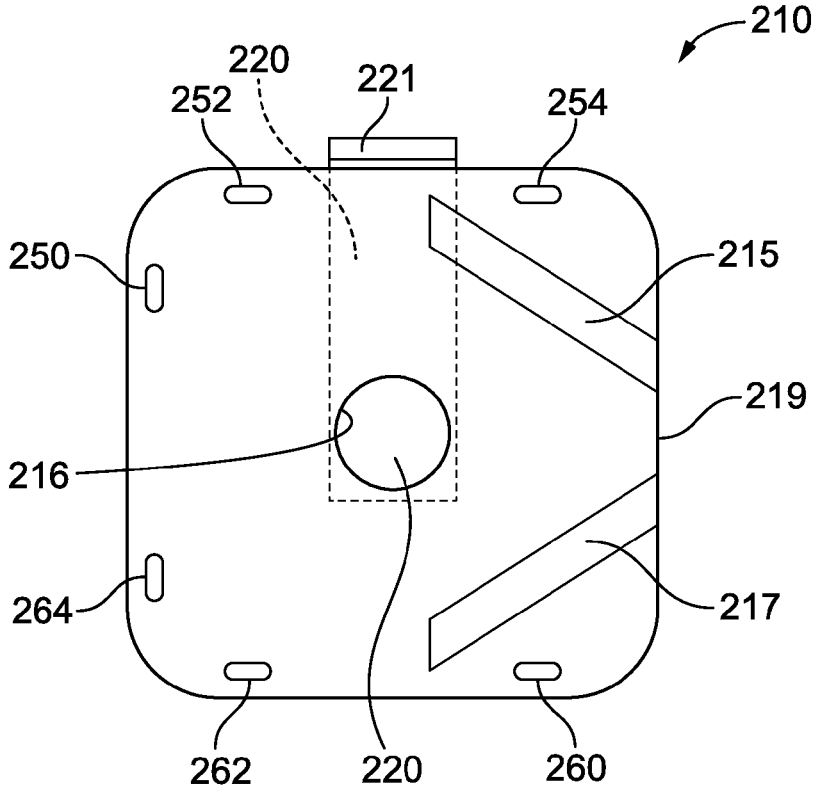
FIG. 11 is a top view of cleanup device 210 having a chute positioned on a top surface thereof.

FIG. 11 is a top view of cleanup tool 210. Cleanup tool 210 is similar to the cleanup tool 10 shown in FIGS. 1-9 with aperture 216 the same as aperture 16, and a plate 220 that is movable from a first closed position as shown in FIG. 11 to a second open position where the aperture 216 is open. Cleanup tool 210 includes a board having aperture 116 extending therethrough and holes 250, 252, 254, 260, 262, and 264 that may serve as handholds for manipulating and transporting cleanup tool 210.

Cleanup tool 210 has a chute positioned on top. The chute is formed of a first chute wall 215 and a second chute wall 217 that extend towards chute outlet 219. Dirt or soil collected on cleanup tool 210 during the process of forming a hole may be directed off by tilting the cleanup tool 210 so that the dirt and soil is directed through chute outlet 219. Similar to FIG. 10, with this design, the cleanup tool 210 may have only one board and only one plate. However, cleanup tool 210 does not include a chute extension.

The cleanup tools and their components shown in FIGS. 1-11, as well as the Figures that follow, may be made of a variety of different materials. For example, the boards, plates, supports, etc. may be made of wood, plastic, or composite materials, or even lightweight metals such as aluminum or magnesium, or a combination of those materials could be used.

It will be appreciated that the use of the cleanup tools shown in FIGS. 1-11, as well as the Figures that follow, may advantageously reduce the amount of dirt and soil that needs to be cleaned up from the ground after the posts are positioned. As a result, the amount of cleanup time and the labor and expense of cleaning up the dirt and soil displaced during the hole forming process is advantageously reduced.

A method of forming holes for fence or deck posts using the cleanup tool shown in FIGS. 1-11, and the Figures that follow may be used to that reduces cleanup time and reduces the labor and expense of cleaning up the dirt and soil displaced during the hole forming process is provided. The method may include the steps of positioning a board having a top surface and a bottom surface over an area where a hole is to be formed in the earth, positioning an aperture located on the board over a spot where the hole is to be formed, positioning a plate slidably attached to the board into a first, open position where the aperture is open, forming a hole in the spot, collecting dirt or soil removed when forming the hole on the top surface of the board, moving the plate to a second, closed position, where the aperture is closed, transporting the board to a place where the dirt or soil may be directed off of the board, and tilting the board to direct dirt or soil that was collected on the board off of the board.

The method may further include the step of moving the top surface of the board towards a top surface of a second board to form a V-shaped surface before the step of tilting the board to direct dirt or soil off the board.

Fences are often placed to fence in yards, or placed adjacent an existing fence or building structure, with a post positioned within inches of the fence or building structure. In such cases, it may not be possible to position the cleanup devices depicted in FIGS. 1-11 against the adjacent fence or building structure, and therefore the hole next to the wall or fence may have to be bored without the benefit of the cleanup device. Therefore, it would be desirable to provide a cleanup device capable of use near a fence or building structure.

Figure 13A:
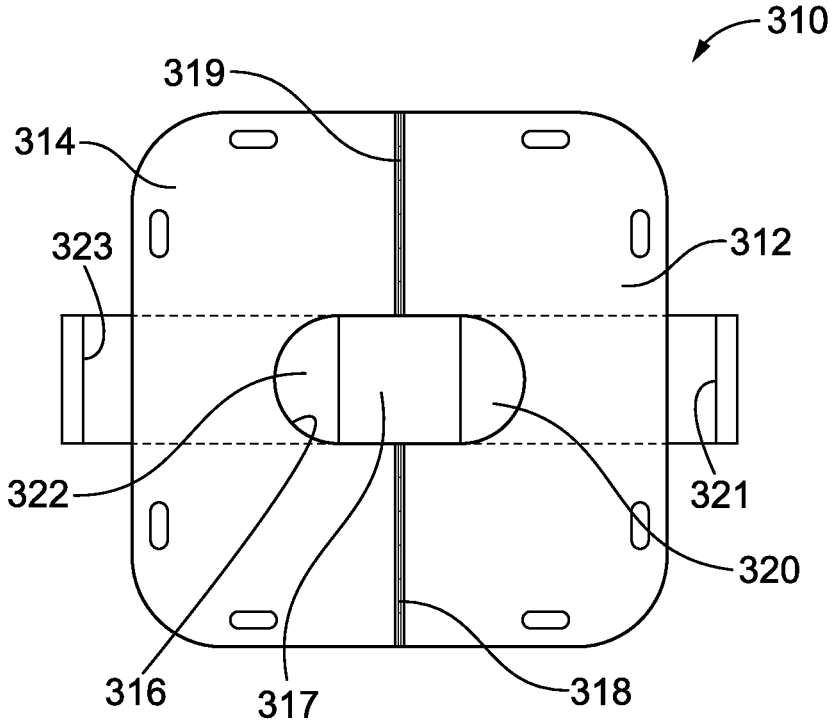
FIG. 13A is a top view of cleanup device 310.

FIG. 13A is a top view of cleanup device 310. Cleanup device 310 includes board 312 attached to board 314 with hinges 318 and 319 with an aperture 317 having edge 316 positioned on boards 312 and 314. Plate 320 is positioned beneath board 312 having an end portion 320 shown partially blocking aperture 317, and plate 322 is positioned beneath board 314 having an end portion 322 shown partially blocking aperture 317.

Figure 13B:
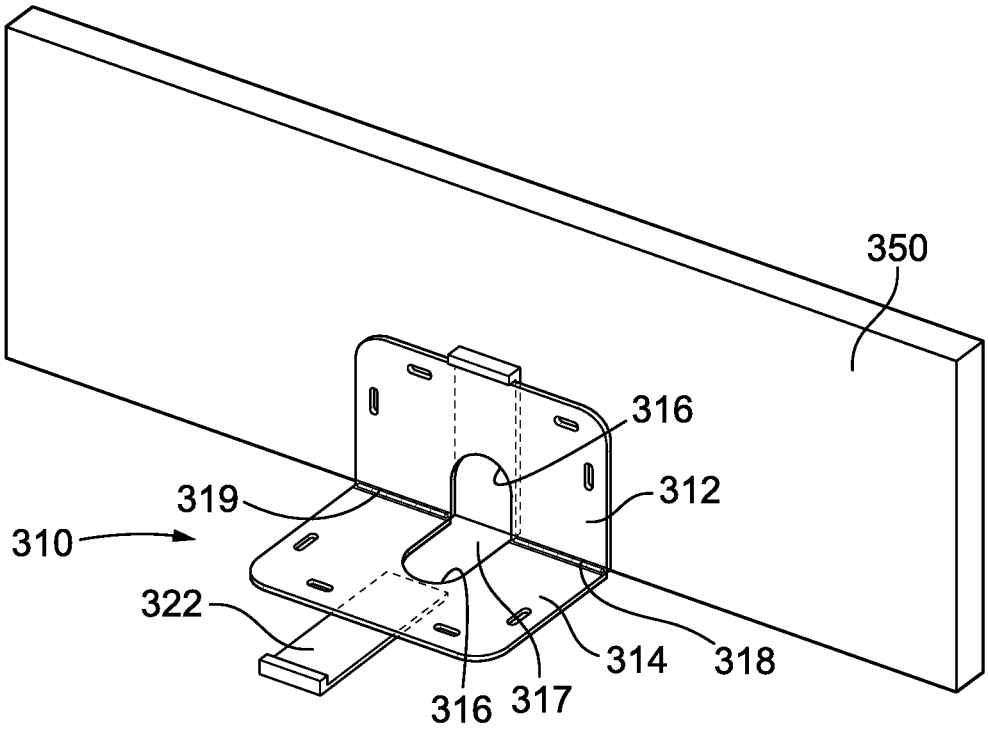
FIG. 13B is a perspective view of cleanup device 310 shown in FIG. 13A, wherein board 312 to positioned against wall 350.

FIG. 13B is a perspective view of cleanup device 310 shown in FIG. 13A, wherein board 312 to positioned against wall 350. In this embodiment, aperture 317 has an elongated oval shape. As a result, board 312 (or board 314) may be placed in an upright position against building structure 350. Plate 322 may be moved into its open position so that an augur may be used to bore a hole through aperture 317.

Although cleanup device 310 is shown with two plates 312 and 314, a single plate may be used to cover the aperture after the hole is bored. Furthermore, a single aperture could also be positioned wholly on board 312 or 314 such that it is not centrally positioned on cleanup device 310. In this manner, cleanup device 310 can be used in conjunction with holes being bored next to an adjacent fence or building structure.

Figure 14A:
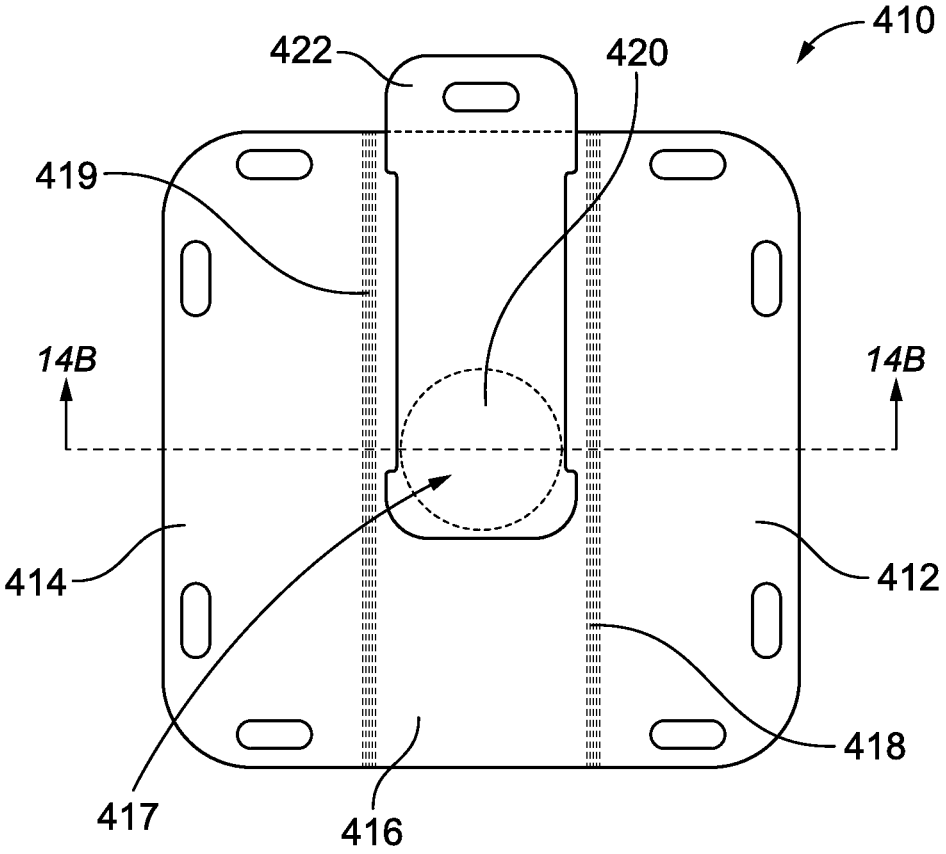
FIG. 14A is a top view of cleanup device 410.

FIG. 14A is a top view of cleanup device 410. Cleanup device 410 includes side members 412 and 414 that may be hingedly attached to base member 416 with hinges 418 and 419. Plate 422 is movably secured to base member 416 and is movable so that portion 420 may block aperture 417 when transporting dirt from the hole site. In the embodiment of cleanup device 410, as well as in the other disclosed embodiments of a cleanup device, the plate 422 may be secured either on the top side or the bottom side of the cleanup device. When the plate 422 is positioned on the bottom side, the dirt and soil removed from the tracks is less likely to clog the tracks in which the plate moves within. For example, plate 422 may ride within tracks formed by securing a pair of rails to the cleanup device. The rails may have apertures that extend in the direction of plate movement and hold the edges of the plate 422 beneath the cleanup device. An embodiment illustrating the use of rails to provide tracks for the edges of a plate is shown in FIGS. 8 and 9.

Figure 14B:
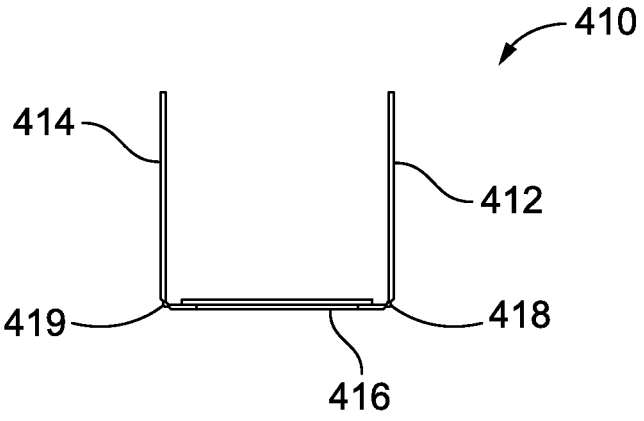
FIG. 14B is a side view of cleanup device 410 shown in FIG. 14B with side members 412 and 414 in an upright position.

In the embodiment of cleanup device 410 shown in FIG. 14A, hinges 418 and 419 are living hinges. A living hinge may be a portion of the device having a reduced thickness and that has a notched cross-section to allow for the side members 412 and 414 to move into an upright position as shown in FIG. 14B. The hinge could also be comprised of a flexible material such as canvas or ripstop nylon being positioned between side member 412 and base member 416, as well as between side member 414 and base member 416, or a sewn hinge. Other conventional hinges may also be used.

During the process of auguring a hole, the dirt and soil removed from the hole may form a pile around the augured hole having a diameter on the order of four feet. Therefore, in order that most or all of the dirt and soil removed from the hole lands on the cleanup device, the cleanup device 410 may advantageously have a width of around 4 feet or more, and a length of around 4 feet or more. Smaller sized cleanup devices may also be used for smaller augurs or augurs that provide smaller diameter piles of removed dirt and soil. Moreover, side members 412 and 414 serve as a chute to direct dirt and soil off of base member 416. In a preferred embodiment, side walls 412 and 414 are rigid, and may be formed of high density polyethylene (HDPE) that is ¼ inch thick (although could be thicker, or thinner in other applications). However, in other embodiments, side members 412 and 414 could be flexible and made of a sturdy, flexible material such as canvas or ripstop nylon, although a rigid side wall is preferred. Similarly, the base member is also preferably rigid, and may also be formed of a high density polyethylene, HDPE that is ¼ inch thick (although could be thicker, or thinner in other applications). It is also possible that base member is formed of a sturdy, flexible material such as canvas or ripstop nylon, although a rigid base member is preferred.

The use of HDPE for the side members 412 and 414, and base member 416, is advantageous because these elements of device 410 may be made from a single piece of material using a thermoforming process. Device 410 may also be produced using a cnc routing machine or through an injection molding process.

Referring back to FIG. 13B, when auguring a hole adjacent to a fence or building structure, it is desirable to have a portion of the cleanup device adjacent the fence or building structure placed in an upright position. However, during the auguring process the portion should remain in the upright position, as it is undesirable to have the upright portion fall towards the hole. Therefore, as shown in FIG. 15A, cleanup device 310*a* is shown having a brace member 330 holding board 314 in an upright position.

Figure 15A:
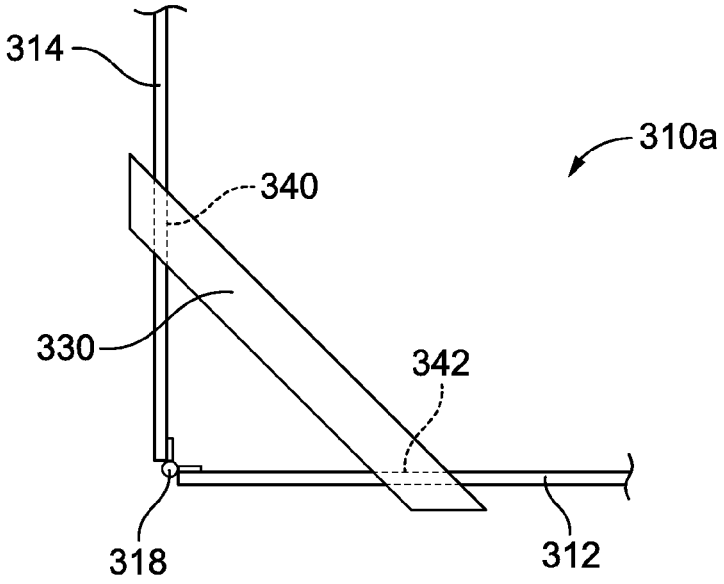
FIG. 15A is a side view of cleanup device 310*a* having brace 330.

In particular, FIG. 15A is a side view of cleanup device 310*a* having brace 330 that has one end that extends through aperture 340 in board 314 and another end extending through aperture 342 in board 312. In this manner, brace member 330 prevents board 314 from pivoting about hinge 318 and onto board 312, and retains board 314 in an upright position during the auguring process.

Figure 15B:
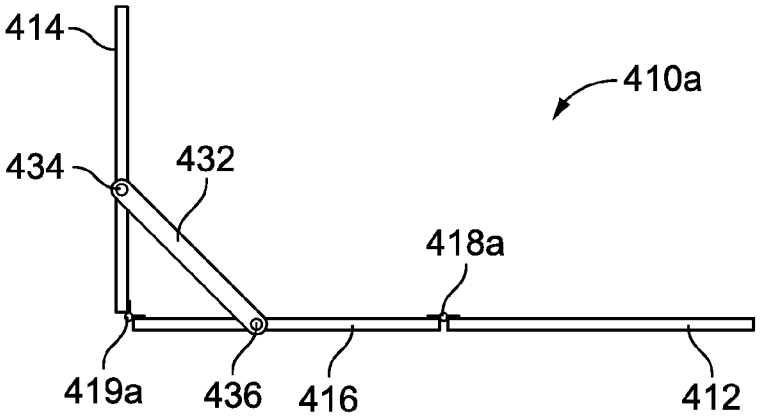
FIG. 15B is a side view of cleanup device 410*a* having brace 432.

FIG. 15B is a side view of cleanup device 410*a* having brace 432. Brace 432 has an end 434 attached to side member 414 and an end 436 attached to base member 412. Brace member 432 prevents side member 414 from pivoting about hinge 419*a* and onto base member 416, and retains side member 414 in an upright position during the auguring process.

Figure 15C:
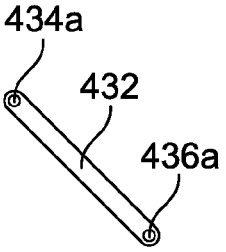
FIG. 15C is a side view of brace 432 shown in FIG. 15B.
Figure 15D:
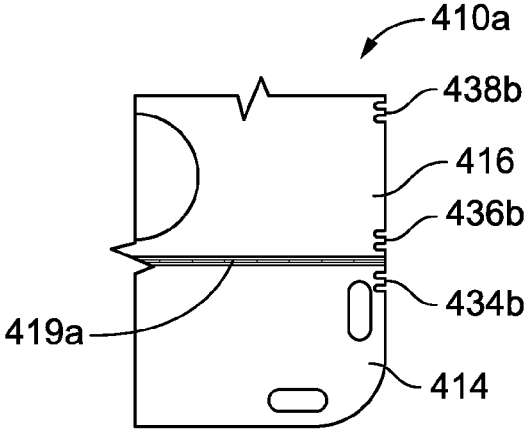
FIG. 15D is a partial top view of cleanup device 410*a* shown in FIG. 15B.

FIG. 15C is a side view of brace 432 shown in FIG. 15B, and FIG. 15D is a partial top view of cleanup device 410*a* shown in FIG. 15B. Brace member 432 includes aperture 434*a* adapted for positioning over post 434*b* positioned between two notches formed in board 414, and brace member 432 also includes aperture 436*a* for positioning over post 436*b* positioned between two notches formed in base member 416. Also shown is post 438*b* used for holding an end of brace member 432 when side member 412 (not shown) is positioned in an upright position against a fence or building structure as illustrated in FIG. 13B.

Figure 16A:
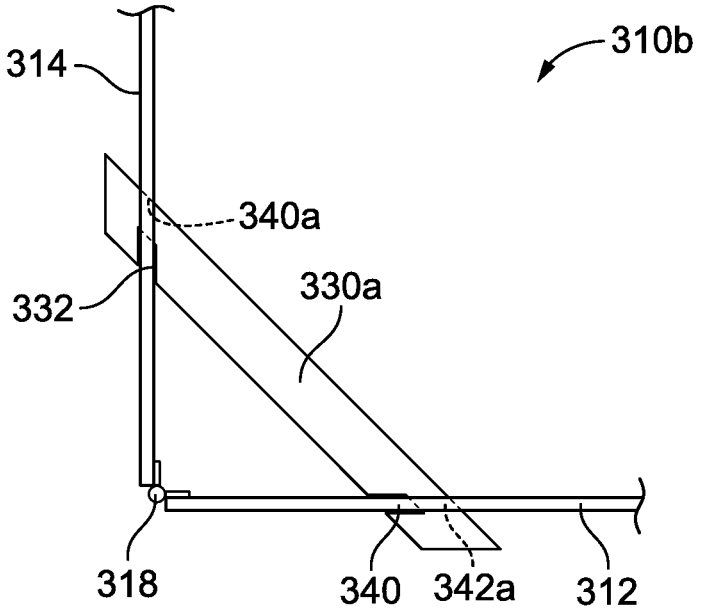
FIG. 16A is a side view of cleanup device 310*b*.
Figure 16B:
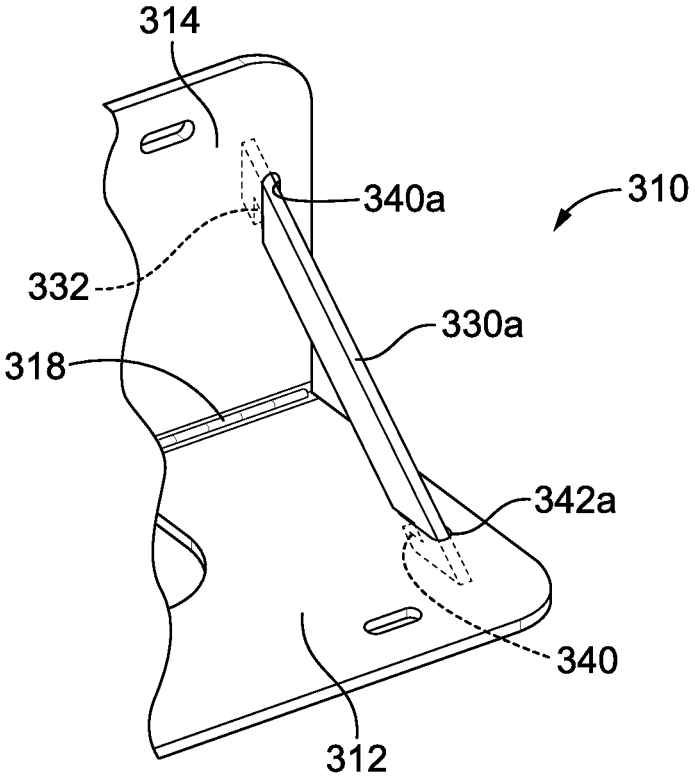
FIG. 16B is a partial perspective view of cleanup device 310*b* shown in FIG. 16A.

FIG. 16A is a side view of cleanup device 310*b* having a brace member 330*a* holding board 314 in an upright position, and FIG. 16B is a partial perspective view of cleanup device 310*b* shown in FIG. 16A. In particular, FIG. 16A illustrates brace member 330*a* that extends through aperture 340*a* in board 314 and another end extending through aperture 342*a* in board 312. Brace member 330*a* includes a notch 332 on one end to secure an end of brace member 330*a* to board 314, and also includes a notch 340 on the other end to secure an end of brace member 330*a* to board 312. In this manner, brace member 330*a* prevents board 314 from pivoting about hinge 318 and onto board 312, and retains board 314 in an upright position during the auguring process.

Figure 17A:
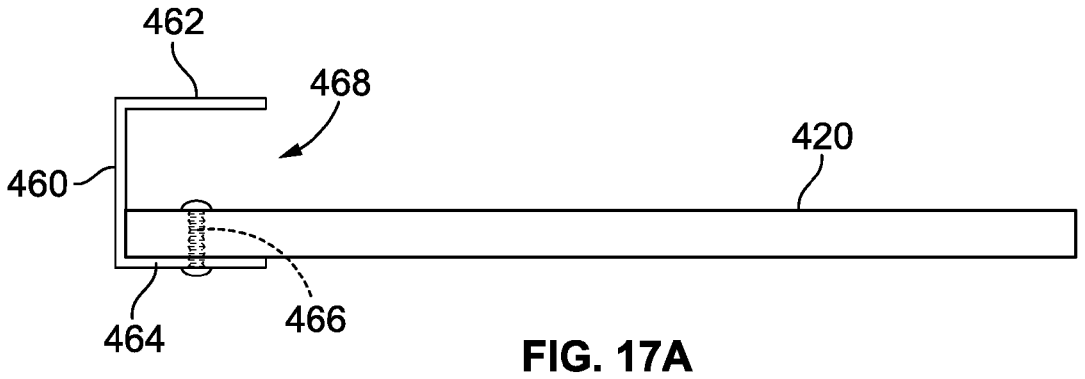
FIG. 17A is a side view of plate 420 having clamp 460 at an end thereof.

FIG. 17A is a side view of plate 420 having clamp 460 at an end thereof. Plate 420 may be used with the various cleanup devices described above. Plate 420 includes a C-clamp having a base 460 and extending arms 462 and 464 secured to plate 420 with screw 466. An aperture 468 is positioned with extending arms 462 and 464 into which the boards or side members of the cleanup device may be positioned. When the plate 420 is moved into its closed position, the extending flange 462 is positioned over the side members or boards and secures them together during transport of the cleanup device. Plate 420 may also serve as a storage location to hold brace members such as those shown in FIGS. 15A-16B above.

Figure 17B:
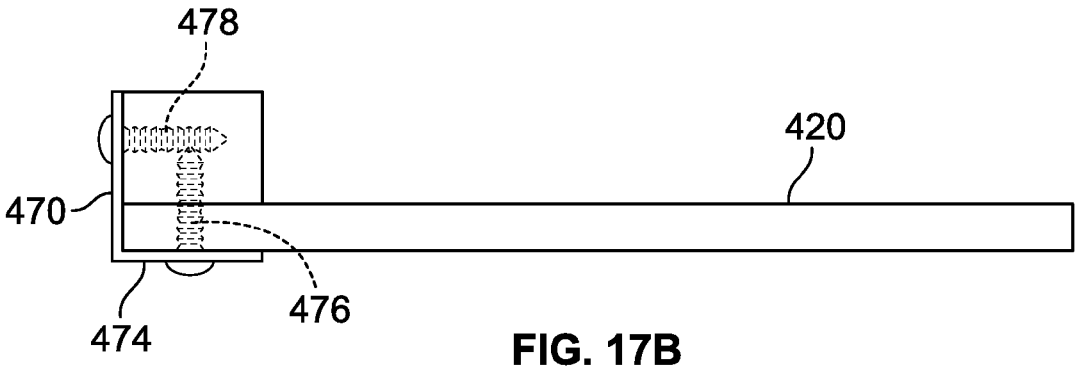
FIG. 17B is a side view of plate 420 having flange 470 at an end thereof.

FIG. 17B is a side view of plate 420 having flange comprising arms 470 and 474 secured to plate 420 using screws 476 and 478. Flange 470 and 474 serve as a kick plate, which a user may kick to move the plate into a closed position, or out of a closed position into an open position.

Figure 17C:
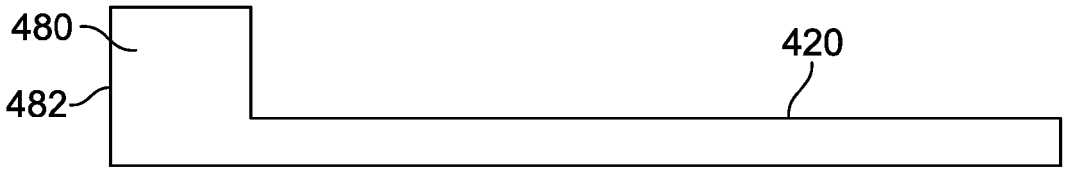
FIG. 17C is a side view of plate 420 having kick plate 480 at an end thereof.

FIG. 17C is a side view of plate 420 having kick plate 480 at an end thereof that may also serve as a kick plate, where a user may kick the front edge 482 of kick plate 480 to move plate 420 into a closed position.

Figure 17D:
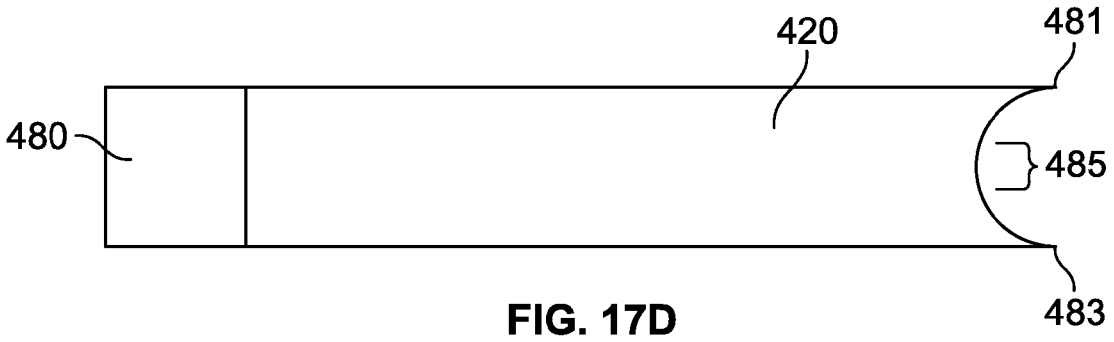
FIG. 17D is a top view of plate 420 having rail cleaning edges.

FIG. 17D is a top view of plate 420 having rail cleaning edges 481 and 483. The rail cleaning edges 481, 483 extend further than a central portion 485 of the end of the plate 420 thereby pushing debris towards the center of the plate 420 and away from the edges where it may get caught in the plate tracks, making it more difficult to move the plate 420 into an open or closed position.

Figure 18A:
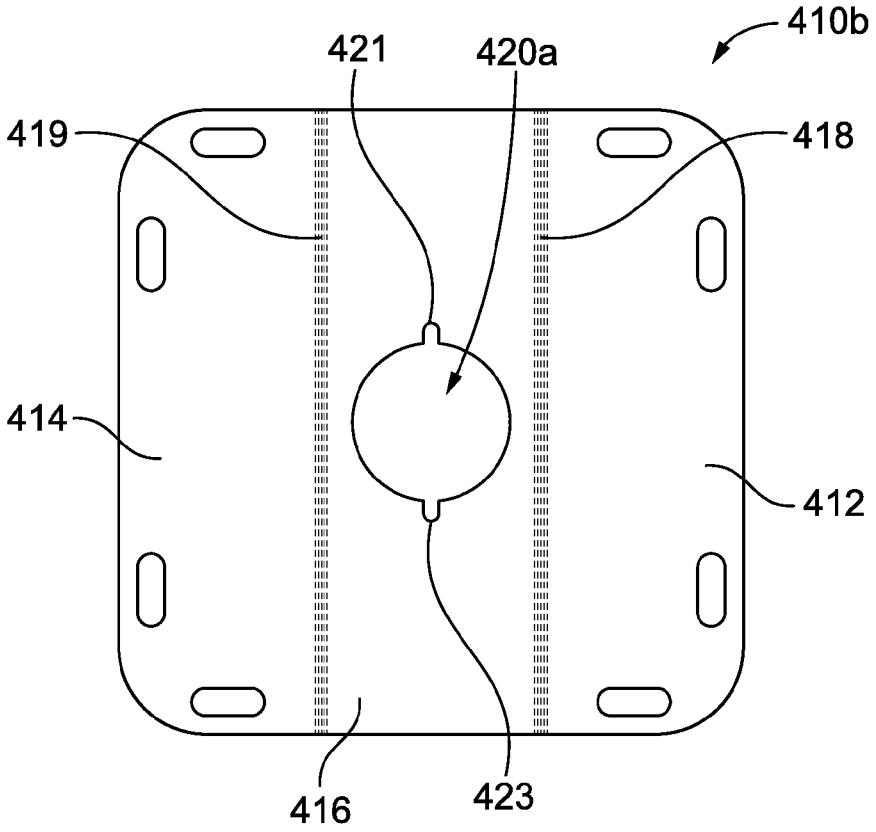
FIG. 18A is a top view of cleanup device 410*b*.
Figure 18B:
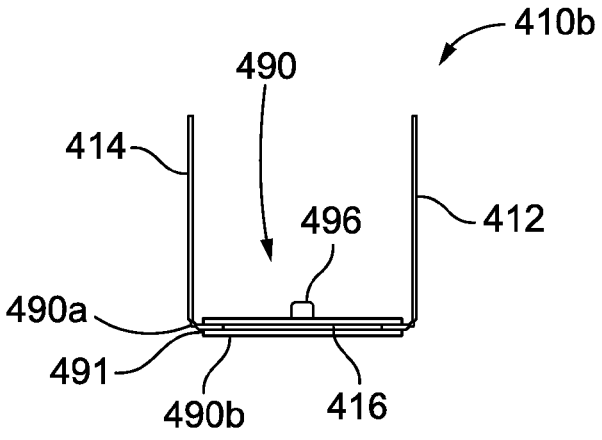
FIG. 18B is a side view of cleanup device 410*b* shown in FIG. 18A with side members 412 and 414 in an upright position, and having plug 490.
Figure 18C:
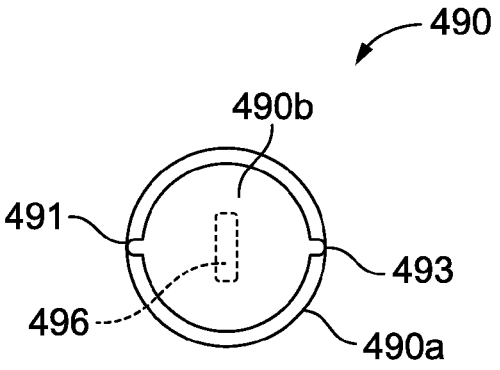
FIG. 18C is a bottom view of plug 490 shown in FIG. 18B.

FIG. 18A is a top view of cleanup device 410*b* and FIG. 18B is a side view of cleanup device 410*b* with side members 412 and 414 in an upright position. Cleanup device 410*b* is similar to cleanup device 410*a* as shown in FIGS. 14A and 14B, but instead of using a plate to block the aperture, a plug 490 is used to block aperture 420*a*. A bottom view of plug 490 is shown in FIG. 18C showing bottom surface 490*b* and outer periphery 490*a*. Cleanup device 410*a* includes side members 412 and 414 that may be hingedly attached to base member 416 with hinges 418 and 419. Aperture 420*a* may include notches 421 and 423 adapted to receive tangs 491 and 493 of plug 490.

In operation, once the augur is removed from aperture 420*a*, the plug is positioned in aperture 490 with outwardly extending tangs 491 and 493 aligned with the notches 421 and 423 of aperture 420*a*. To secure the plug 490 within base member 416, the plug 490 is rotated using for example a handle, such as handle 496 to lock the plug in place as the tangs extend beneath the base member 416. When locked in position, plug 490 has a periphery 490*a* that extends beyond the diameter of aperture 420*a*, and thereby prevents removed dirt from falling through aperture 420*a* during transport away from the hole site.

The handle in FIGS. 18B and 18C is shown as upwardly extending from plug 490 as an illustrative embodiment. Other handles could be used as well, such as a pair of holes disposed in the top of plug 90 that a user could insert a thumb and finger to rotate the plug 490 into a locked secured position within aperture 420*a* within base member 416. Using a pair of holes advantageously allows the top surface of plug 490 to remain generally flush with the top surface of base member 416, which does not hinder the dirt and soil from sliding off of base 416 when cleanup device 410*b* is tipped to remove the dirt and soil. Although two outwardly extending tangs (491 and 493) are shown on plug 490, a single tang, or more than two tangs could also be used.

In this embodiment of cleanup device 410*b*, hinges 418 and 419 are living hinges. Although, as with the cleanup device 410*a* shown in FIGS. 14A and 14B, the hinges could also be comprised of a flexible material such as canvas or ripstop nylon being positioned between side member 412 and base member 416, as well as between side member 414 and base member 416, or a sewn hinge. Other conventional hinges may also be used.

Figure 19A:
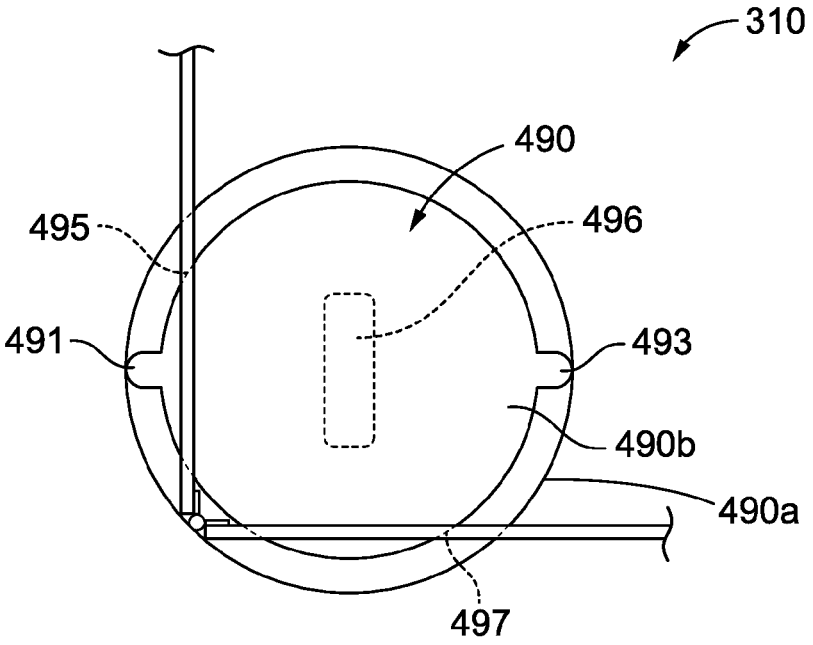
FIG. 19A is a side view of cleanup device 310 having plug 490 used as a brace.
Figure 19B:
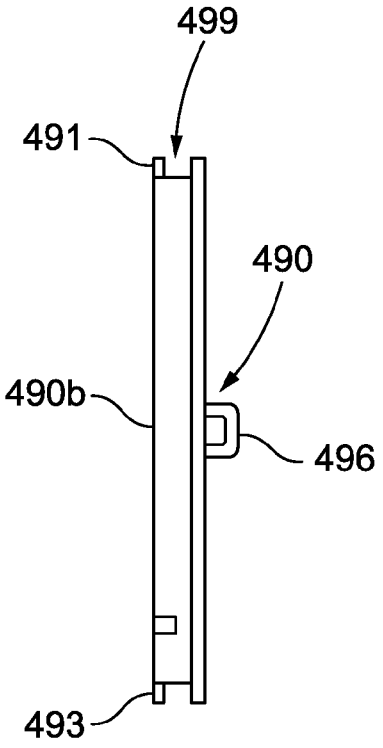
FIG. 19B is a side view of plug 490 shown in FIGS. 18A-18C and 19A.
Figure 19C:
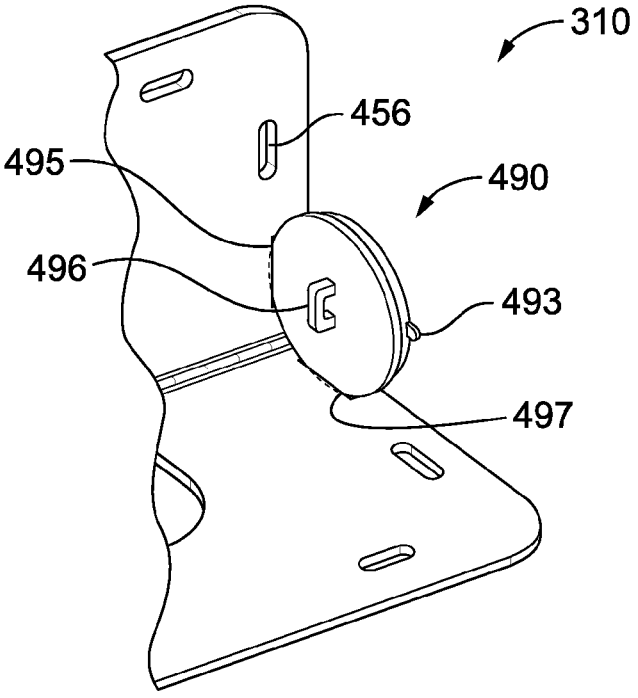
FIG. 19C is a partial perspective view of cleanup device 310 shown in FIG. 19A.

FIG. 19A is a side view of cleanup device 310 having plug 490 used as a brace; FIG. 19B is a side view of plug 490 shown in FIGS. 18A-18C and 19A; and FIG. 19C is a partial perspective view of cleanup device 310 shown in FIG. 19A. As shown in FIG. 19B, plug 490 includes a handle 496, outwardly extending tangs 491 and 493, and bottom surface 490*b*. A slot 499 extends between tangs 491, 493 and a top surface of plug 490. In order to serve as a brace member, plug 490 has an edge that extends through an aperture 495 in the upright board and an edge that extends through aperture 497 that extends through the bottom board. In this manner, the plug may be used to hold board in an upright position when positioned against an adjacent fence or building structure.

Using the plug 490 as a brace member during augur drilling against an adjacent fence or building structure provides the advantage of using an existing component of the cleanup device, without requiring a separate and additional brace member. In addition, the plug member 490 may be advantageously secured within aperture 420*a* during transport, helping to insure that the brace member does not become separated from the cleanup device when not in use, and reducing the possibility that the brace member will become lost.

Figure 20A:
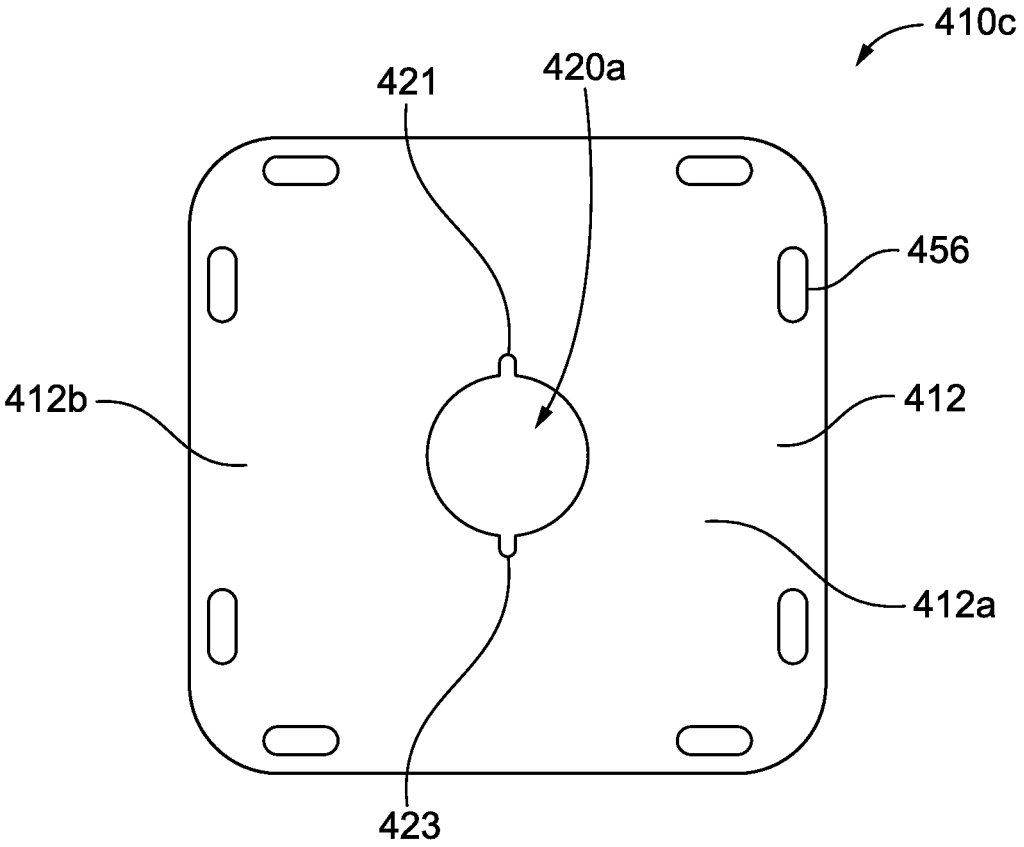
FIG. 20A is a top view of cleanup device 410*c*.
Figure 20B:
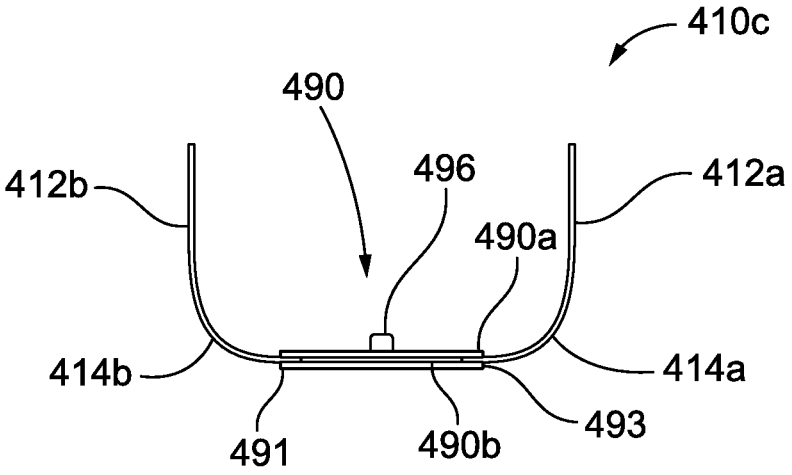
FIG. 20B is a side view of cleanup device 410*c* shown in FIG. 20A.

FIG. 20A is a top view of cleanup device 410*c*, and FIG. 20B is a side view of cleanup device 410*c* shown in FIG. 20A. Cleanup device 410*c* is similar to cleanup devices 410*a* and 410*b* except cleanup device 410*c* does not include a plate or hinges. As shown in FIGS. 20A and 20B, cleanup device 410*c* includes a base 412 having an aperture 420*a* positioned therein. The aperture 420*a* may have a diameter that is sized to accommodate an 8-inch auger positioned through the aperture 420*a* when a hole is being drilled by the auger. Aperture 420*a* is illustrated having notches 421 and 423 adapted to receive tangs 491 and 493 of plug 490. Side members 412*a* and 412*b* are shown extending from opposite sides of aperture 420*a*. Plug 490 may be configured as shown in FIGS. 18C and 19B.

In cleanup device 410*c*, as shown in FIG. 20B, the first and second side members 412*a* and 412*b* are comprised of flexible material, such as a thin plastic, such that the portion of the base 412 having the aperture 420*a* sags between the first side 412*a* and the second side 412*b* of the base 412 when the base is lifted by the handles 456 when dirt and debris is on the cleanup device 410*c* after a hole has been augured. As the term is used herein, a "handle" may be an aperture such as handle 456, or may be component that may be grasped such as a strap, post, or knob. Periphery 490*a* of plug 490 has a diameter greater than the diameter of aperture 420*a*. Therefore, plug 490 may be used to prevent the dirt and soil accumulated on base 412 during the auguring process from falling through the aperture 420*a* as the cleanup device 410*c* is transported to an area to offload the dirt and soil.

Tangs 491 and 493 on plug 490 may be used as described above to secure the plug 490 within aperture 420*a*. In the embodiment of cleanup device 410*c* shown in FIG. 20B, the side members 412*a* and 412*b* may generally bend at areas

414*a* and 414*b* respectively. With this embodiment, the cleanup device 410*c* advantageously does not require a separate plate or plates to block the aperture, as plug 490 is used. Furthermore, because of the flexible nature of side members 412*a* and 412*b*, hinges are also not required. Thus, cleanup device 410*c* advantageously provides an elegant solution to removing dirt and soul from an augured hole without requiring additional components. In particular, cleanup device may only require two components, the base 412 with side members 412*a* and 412*b*, and the plug 490.

As noted above, typical fence or deck posts may be 4 inches by 4 inches, in which case an auger having an 8-inch diameter bit may be used, while other fence and deck posts may be 5 inches by 5 inches, in which case an auger having a 10-inch diameter bit may be used. Therefore, the diameter of aperture shown in cleanup device 310 and 410*a-c* may be sized to accommodate at least an 8-inch bit. However, to accommodate both an 8-inch diameter bit and a 10-inch diameter bit, the diameter of aperture 16 should be 12 inches or more. However, the larger the diameter of the aperture, the more dirt and soil will drop back onto the area surrounding the hole, instead of onto the cleanup device as desired. Therefore, it has been found that an aperture with a diameter of 12 inches provides sufficient flexibility to accommodate an 8-inch bit and a 10-inch bit without allowing too much dirt or soil to fall through the aperture 16. It will be appreciated that while apertures are shown as a circular hole, other geometries for the aperture which may not be as advantageous as a circular hole could be used as well. In addition, the cleanup device 310 and 410*a-c* may also be used for other larger applications. For example, a telephone pole may require a 16 inch diameter hole, and the aperture of the cleanup device may be sized to accommodate a hole of that size, or larger, as well.

Example embodiments have been described above. Those skilled in the art will understand that changes and modifications may be made to the described embodiments without departing from the true scope and spirit of the present invention, which is defined by the claims.

We claim:

1. A device for the cleanup of dirt or soil removed when forming a hole in the earth, comprising:

a first board having an inner edge and an outer edge;

a second board having an inner edge and an outer edge;

a first hinge attached to the inner edge of the first board and the inner edge of the second board;

an aperture positioned between the outer edge of the first board and the outer edge of the second board;

wherein a top surface of the first board is movable towards a top surface of the second board to form a V-shaped surface for directing dirt or soil off of the first board and the second board; and further including a first plate slidably attached to the first board;

wherein the first plate is movable from a first, open position where the aperture is open, to a second, closed position where the first plate extends over at least a portion of the aperture.

2. The device of claim 1, wherein the aperture has a diameter that is sized to accommodate an 8-inch auger positioned through the aperture when the hole is being drilled by the auger.

3. A device for the cleanup of dirt or soil removed when forming a hole in the earth, comprising:

a first board having an inner edge and an outer edge;

a second board having an inner edge and an outer edge;

a first hinge attached to the inner edge of the first board and the inner edge of the second board;

an aperture positioned between the outer edge of the first board and the outer edge of the second board;

wherein a top surface of the first board is movable towards a top surface of the second board to form a V-shaped surface for directing dirt or soil off of the first board and the second board; and further including a plug sized to fit within the aperture.

4. The device of claim 3, wherein the plug has one or more extending tabs adapted to fit within one or more slots extending from a periphery of the aperture, and wherein the plug is rotatable within the aperture and the one or more extending tabs are positioned beneath a surface of the device to secure the plug within the aperture.

5. The device of claim 3, wherein the plug has a first edge positionable within an aperture in the first board and the plug has a second edge positionable within an aperture in the second board to hold the second board in an upright position adjacent a wall.

6. A device for the cleanup of dirt or soil removed when forming a hole in the earth, comprising:

a base member;

a first side member attached to a first side of the base member;

a second side member attached to a second side of the base member;

an aperture positioned within the base member;

wherein the first side member is movable to an upright position and the second side member is movable to an upright position for directing dirt or soil off of the base member; and further including a first plate slidably attached to the second board;

wherein the first plate is movable from a first, open position where the aperture is open, to a second, closed position where the first plate extends over at least a portion of the aperture.

7. The device of claim 6, wherein a brace member extends between the first board and the second board to hold the second board in an upright position adjacent a wall.

8. A device for the cleanup of dirt or soil removed when forming a hole in the earth, comprising:

a base member;

a first side member attached to a first side of the base member;

a second side member attached to a second side of the base member;

an aperture positioned within the base member;

wherein the first side member is movable to an upright position and the second side member is movable to an upright position for directing dirt or soil off of the base member; and further including a plug sized to fit within the aperture.

9. The device of claim 8, wherein the plug has one or more extending tabs adapted to fit within one or more slots extending from a periphery of the aperture, and wherein the plug is rotatable within the aperture and the one or more extending tabs are positioned beneath a surface of the device to secure the plug within the aperture.

10. The device of claim 6, wherein the first side member is foldable over the base member and the second side member is also foldable over the base member to provide a folded device for improved carrying and storage of the device.

11. The device of claim 10, wherein the first plate has C-shaped flange which extends over an end of the first side member, an end of the base member, and an end of the second side member to secure the device in a folded position.

12. The device of claim 10, wherein the first side member is attached to the base member with a first living hinge and the second side member is attached to the base member with a second living hinge.

13. The device of claim 8, wherein the plug has a first edge positionable within an opening in at least one of the first side member and the second side member, and the plug has a second edge positionable within an opening in the base member to hold the at least one of the first side member and second side member in an upright position adjacent a wall.

14. A device for the cleanup of dirt or soil removed when forming a hole in the earth, comprising:

a base having an aperture positioned therein;

wherein the aperture has a diameter that is sized to accommodate an 8-inch auger positioned through the aperture when the hole is being drilled by the auger;

one or more handles positioned on a first side of the base and one or more handles positioned on a second side of the base opposite from the first side of the base;

wherein the first and second side members are comprised of flexible material such that the portion of the base having the aperture sags between the first side and the second side of the base when the base is lifted by the handles; and further including a plug sized to fit within the aperture.

15. The device of claim 14, wherein the plug has one or more extending tabs adapted to fit within one or more slots extending from a periphery of the aperture, and wherein the plug is rotatable within the aperture and the one or more extending tabs are positioned beneath a surface of the device to secure the plug within the aperture.

16. The device of claim 14, further including a plate slidably attached to the base;

wherein the plate is movable from a first, open position where the aperture is open, to a second, closed position where the plate extends over at least a portion of the aperture.

* * * * *